US011660648B2

(12) United States Patent
Kinnstaetter et al.

(10) Patent No.: US 11,660,648 B2
(45) Date of Patent: May 30, 2023

(54) COOLING OF AN OBLIQUELY POSITIONED FLAT ROLLED PRODUCT

(71) Applicant: Primetals Technologies Germany GmbH, Erlangen (DE)

(72) Inventors: Klaus Kinnstaetter, Hirschaid (DE); Klaus Weinzierl, Nuremberg (DE)

(73) Assignee: PRIMETALS TECHNOLOGIES GERMANY GMBH

( * ) Notice: Subject to any disclaimer, the term of this patent is extended or adjusted under 35 U.S.C. 154(b) by 142 days.

(21) Appl. No.: 17/179,686

(22) Filed: Feb. 19, 2021

(65) Prior Publication Data

US 2021/0178444 A1 Jun. 17, 2021

Related U.S. Application Data

(62) Division of application No. 16/644,210, filed as application No. PCT/EP2018/072745 on Aug. 23, 2018, now Pat. No. 10,960,447.

(30) Foreign Application Priority Data

Sep. 19, 2017 (EP) ..... 17191730

(51) Int. Cl.
*B21B 45/02* (2006.01)
*B21B 39/02* (2006.01)

(52) U.S. Cl.
CPC ..... *B21B 45/0209* (2013.01); *B21B 39/02* (2013.01)

(58) Field of Classification Search
CPC ..... B21B 45/0218; B21B 39/223–32; B21B 39/20; B21B 39/22; B21B 41/00;
(Continued)

(56) References Cited

U.S. PATENT DOCUMENTS 3,241,735 A * 3/1966 Ranney ..... C21D 9/56 352/159
3,606,279 A * 9/1971 Auger ..... C21D 9/56 266/112

(Continued)

FOREIGN PATENT DOCUMENTS

CN 2487462 Y 4/2002
CN 101300089 A 11/2008

(Continued)

OTHER PUBLICATIONS

Takase, Translation of JPS6363519 (Year: 1988).*

(Continued)

*Primary Examiner* — David Duffy
*Assistant Examiner* — Bobby Yeonjin Kim
(74) *Attorney, Agent, or Firm* — Ostrolenk Faber LLP

(57) ABSTRACT

A flat rolled metal product (1) is first hot-rolled in at least one rolling stand (2), then fed to a cooling zone (5) arranged downstream of the rolling stand (2) and finally cooled in the cooling zone (5). During the rolling in the rolling stand (2), the flat rolled product (1) is oriented horizontally. Before running into the cooling zone (5) and/or when running into the cooling zone (5), the flat rolled product (1) is turned by a first acute angle (a) about an axis running in the transporting direction (x), so that after completion of the turning about the axis the flat rolled product (1) is oriented obliquely. The flat rolled product (1) is cooled in the cooling zone (5) while it is oriented obliquely. The product (1) is then returned to horizontal orientation.

5 Claims, 3 Drawing Sheets

(58) Field of Classification Search
CPC ..... B21B 41/06; B21B 41/08; B21B 39/00; B21B 39/04; B21B 39/14; B21B 39/02; B65G 13/12
USPC ..... 198/826
See application file for complete search history.

(56) References Cited

U.S. PATENT DOCUMENTS

| | | | | |
|---|---|---|---|---|
| 4,330,112 | A | 5/1982 | Toshimitsu et al. | |
| 8,506,879 | B2 | 8/2013 | Ueoka | |
| 2003/0102401 | A1* | 6/2003 | Muller | B21B 39/006 242/534.1 |
| 2004/0006998 | A1 | 1/2004 | Franz et al. | |

FOREIGN PATENT DOCUMENTS

| | | | | | |
|---|---|---|---|---|---|
| CN | 202762752 | U | | 3/2013 | |
| DE | 101 29 565 | A1 | | 1/2003 | |
| EP | 0 927 603 | A1 | | 7/1999 | |
| JP | S63-063519 | A | | 3/1988 | |
| JP | S6363519 | A | * | 3/1988 | B21B 39/12 |

OTHER PUBLICATIONS

Chinese Office Action, dated Feb. 19, 2021, issued in corresponding Chinese Patent Application No. 201880060919.6. English translation. Total 14 pages.
International Search Report dated Nov. 28, 2018 in corresponding PCT International Application No. PCT/EP2018/072745.
Written Opinion dated Nov. 28, 2018 in corresponding PCT International Application No. PCT/EP2018/072745.

* cited by examiner

COOLING OF AN OBLIQUELY POSITIONED FLAT ROLLED PRODUCT

CROSS-REFERENCE TO RELATED APPLICATIONS

The present invention is a division of U.S. patent application Ser. No. 16/644,210, filed Mar. 4, 2020, which is a 35 U.S.C. § 371 National Phase conversion of PCT/EP2018/072745, filed Aug. 23, 2018, the contents of which are incorporated herein by reference, which claims priority of European Patent Application No. 17191730.5 filed Sep. 19, 2017, the contents of which are incorporated by reference herein. The PCT International Application was published in the German language.

TECHNICAL FIELD

The present invention relates to a method for producing flat rolled metal product,

- wherein the flat rolled product is first hot-rolled in at least one rolling stand, then fed in a horizontal transporting direction at a transport speed to a cooling zone arranged downstream of the rolling stand and finally cooled in the cooling zone,
- wherein the flat rolled product is oriented horizontally during the rolling in the rolling stand.

The present invention further relates to an apparatus for producing a flat rolled metal product,

- wherein the apparatus has at least one rolling stand and a cooling zone arranged downstream of the rolling stand,
- wherein the rolling stand has rolls which are rotatable about horizontal axes such that the flat rolled product is oriented horizontally during the rolling in the rolling stand,
- wherein between the rolling stand and the cooling zone and in the cooling zone the apparatus has transport rollers by means of which the flat rolled product is fed to the cooling zone in a horizontal transporting direction and guided through the cooling zone,
- wherein the transport rollers have first axes of rotation.

BACKGROUND ART

The above-cited subject matters are generally known. Reference may be made purely by way of example to DE 101 29 565 A1 and the corresponding US 2004/0 06 998 A1.

Following the hot-rolling process, the flat rolled product is cooled in the cooling zone of a rolling mill. In particular, precise temperature control is standard practice in the cooling zone in order to set the desired material properties of the flat rolled product and maintain said properties constant with the lowest possible statistical dispersion. Examples of cooling zones of said type are the cooling zone of a hot-strip mill line with or without intensive cooling or the so-called chill-hardening quench of a heavy-plate mill line.

During cooling of the flat rolled product, large volumes of liquid coolant (generally water) are applied to the still hot flat rolled product both from above and from below. The coolant applied to the undersurface can then drop downward due to gravity so that the coolant that is applied to the flat rolled product from below at a specific point in the cooling zone does not interfere with the subsequent further cooling of the undersurface of the flat rolled product. Coolant applied to the top surface, on the other hand, may remain lying on the flat rolled product. Firstly, this results in an undefined cooling process. Secondly, the coolant that remains standing affects the cooling action that is intended to be produced by a subsequent further cooling of the top surface of the flat rolled product. In particular, an inhomogeneous cooling process can cause the flat rolled product to curve upward, resulting in an accumulation of coolant in the center. Further problems present themselves at greater transport speeds.

It is known in the prior art to use side jet spray arrays which cause the coolant present on the top surface of the flat rolled product to drain off to the side.

A system is furthermore known in which the flat rolled product is embodied as a strip and is turned to a vertical position during the cooling phase in the cooling zone. Uniform cooling on both sides is achieved with this system. However, this method can be applied only in the case of relatively narrow and thin strips. Furthermore, there exists the risk that the strips will be damaged on the side edge on which they are guided.

SUMMARY OF THE INVENTION

The object of the present invention is to provide possible solutions by means of which a defined cooling can be achieved on both sides of the flat rolled product while the risk of damage to the flat rolled product, in particular on the side edge, can be reliably avoided.

The object is achieved by means of a production method disclosed herein.

According to the invention, a production method of the type cited in the introduction is embodied in that

- before running into the cooling zone and/or when running into the cooling zone, the flat rolled product is turned through a first acute angle about an axis running in the transporting direction such that after completion of the turning movement about the axis the flat rolled product is oriented obliquely, and
- the flat rolled product is cooled in the cooling zone while it is oriented obliquely.

What is achieved thereby is that the flat rolled product is still supported on the transport rollers even while being oriented obliquely and is transported by said rollers. The coolant applied to the top surface can nonetheless reliably drain away from the top surface.

When running out from the cooling zone and/or after running out from the cooling zone, the flat rolled product is preferably turned back through the first acute angle about the axis such that after completion of the reverse turning movement the flat rolled product is oriented horizontally once more. This enables the further processing and finishing of the flat rolled product taking place after the cooling phase to be performed in the customary manner.

The first acute angle must on the one hand be great enough so that the coolant drains away reliably from the top surface of the flat rolled product. On the other hand, the angle should be chosen as low as possible so that the flat rolled product continues to be reliably guided by the transport rollers. In trials it has proven beneficial for the first acute angle to lie in the range between 5° and 30°, in particular between 10° and 25°, for example at approx. 15° to 20°. In individual cases, however, greater angles—even above and beyond 45°—are also possible. A smaller angle may also be possible in quite rare individual cases.

It is possible that in order to turn the flat rolled product through the first acute angle, the horizontal positioning of the flat rolled product, viewed in the width direction of the flat rolled product, is maintained at one side edge and raised at the other side edge. Generally, however, it is better if the horizontal positioning of the flat rolled product, viewed in the width direction of the flat rolled product, is maintained at one side edge and lowered at the other side edge. In particular, "let gravity do its work" is the approach adopted in this case. As a further alternative, it is possible to provide a combination of these two measures in order to turn the flat rolled product through the first acute angle, i.e. the horizontal positioning of the flat rolled product, viewed in the width direction of the flat rolled product, is raised at one side edge and lowered at the other side edge.

Generally, the flat rolled product is guided and supported from the rolling stand to the cooling zone and in the cooling zone by means of a series of sequential transport rollers disposed in the transporting direction, the transport rollers being rotatable about first axes of rotation. In this case the flat rolled product is preferably raised and/or lowered step by step by means of a corresponding orientation of the first axes of rotation of sequentially arranged transport rollers.

In the section in which it is oriented obliquely, the flat rolled product is preferably fixed in position by means of a guide device arranged at the side of the flat rolled product, viewed in the width direction of the flat rolled product. In particular, a precise lateral guidance of the flat rolled product can be ensured by this means. This measure thus enables in particular a precise edge masking.

The guide device can in particular include holdback rollers which are arranged sequentially in series, viewed in the transporting direction of the flat rolled product, and are rotatable about second axes of rotation. Preferably, the second axes of rotation form a second acute angle with the width direction of the flat rolled product, the arms of said second angle both having an upward-directed component. The holdback rollers are therefore inclined inward, referred to the roller table defined by the transport rollers. This measure makes it difficult for the head of the flat rolled product to fly upward.

Preferably, the sum of the first acute angle and the second acute angle is less than 90°, in particular less than 85°. An upward excursion of the head of the flat rolled product can be particularly reliably avoided by this means. The sum of the first acute angle and the second acute angle should however be greater than 75°, in particular greater than 80°.

Owing to the inclined attitude of the flat rolled product, it is possible in particular for the transport speed to be greater than 11.5 m/s, in particular greater than 15 m/s.

The object is further achieved by means of an apparatus for producing a flat rolled metal product having the features disclosed herein.

According to the invention, an apparatus of the type cited in the introduction is embodied such that the first axes of rotation form a first acute angle with the horizontal, at least in a central section of the cooling zone, and the transport rollers are oriented in such a way before the run-in into the cooling zone and/or during the run-in in the cooling zone that the first axes of rotation of sequentially arranged transport rollers progressively run more and more obliquely until the first acute angle is reached, or the associated transport rollers are pivotable about an axis running in the transporting direction.

Preferably, the transport rollers positioned downstream of the run-out from the cooling zone and/or in the run-out from the cooling zone are oriented in such a way that the first axes of rotation of sequentially arranged transport rollers progressively run less and less obliquely until the horizontal is reached, or the associated transport rollers are pivotable about an axis running in the transporting direction. This enables the further processing and finishing of the flat rolled product taking place after the cooling phase to be performed in the customary manner.

Preferably, the apparatus has a guide device at the lower side, at least in the section in which the first axes of rotation of the transport rollers form the first acute angle, by means of which guide device the flat rolled product is fixed in position, viewed in the width direction of the flat rolled product. In particular a precise lateral guidance of the flat rolled product can be ensured by this means. This measure thus enables in particular a precise edge masking.

Preferably, the guide device has holdback rollers arranged sequentially in series, viewed in the transporting direction of the flat rolled product, which are rotatable about second axes of rotation, the second axes of rotation forming a second acute angle with the width direction of the flat rolled product, the arms of said second angle both having an upward-directed component. This measure makes it difficult for the head of the flat rolled product to fly upward.

The sum of the first acute angle and the second acute angle is preferably less than 90°, in particular less than 85°. An upward excursion of the head of the flat rolled product can be particularly reliably avoided by this means.

BRIEF DESCRIPTION OF THE DRAWINGS

The above-described characteristics, features and advantages of this invention, as well as the manner in which they are achieved, will become clearer and more readily understandable taken in conjunction with the following description of the exemplary embodiments, which are explained in more detail in connection with the schematic drawings, in which.

DESCRIPTION OF THE EMBODIMENT VARIANTS

Figure 1:
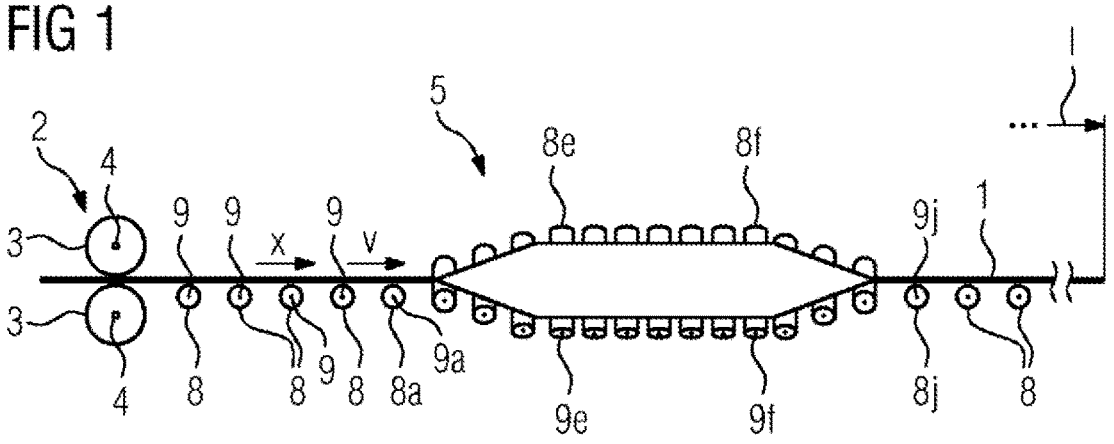
FIG. 1 shows an apparatus for producing a flat rolled product.

According to FIG. 1, an apparatus for producing a flat rolled product 1 has a rolling stand 2. The flat rolled product 1 consists of metal. The metal may in particular be steel. Alternatively, it may be a different metal, for example aluminum, brass or copper. The flat rolled product 1 may be a strip or a heavy plate. In the case of a strip, the flat rolled product 1 has a thickness d (see FIG. 2) of less than 26 mm. The thickness d is often much smaller. For example, the thickness d of the flat rolled product 1 may amount to only approx. 2 mm. The thickness d may also be even smaller, for example only 0.8 mm, 1 mm or 1.5 mm. In the case of a heavy plate, the flat rolled product 1 has a thickness d of at least 3 mm.

The flat rolled product 1 extends in a transporting direction x over a length 1. If the flat rolled product 1 is a strip, the length 1 may amount to a fair number of meters. In particular, the length 1 in this case lies generally in the two- or three-digit meter range. With very thin strips, the length 1 may even amount to more than 1 km. In the case of a heavy plate, the length 1 lies in the range of a few meters, generally around 100 m at maximum. In a width direction y, the flat rolled product 1 extends over a width b. The width b may be—but is not necessarily—1 m and greater.

Only the working rolls 3 of the rolling stand 2 are shown in FIG. 1. However, the rolling stand 2 may include further rolls, for example backup rolls in the case of a four-high stand or backup rolls and intermediate rolls in the case of a six-high stand. The flat rolled product 1 is hot-rolled in the rolling stand 2.

The rolls 3 are rotatable about roll axes 4. The roll axes 4 run horizontally and are arranged one above the other. Accordingly, the flat rolled product 1 is oriented horizontally during the rolling in the rolling stand 2. After the rolling in the rolling stand 2, the flat rolled product 1 runs out from the rolling stand 2 in a horizontal transporting direction x and at a transport speed v. In certain circumstances the transport speed v may be greater than 11.5 m/s, in particular greater than 15 m/s.

The apparatus further comprises a cooling zone 5. The cooling zone 5 is arranged downstream of the rolling stand 2. After running out from the rolling stand 2, the flat rolled product 1 is therefore fed to the cooling zone 5. The flat rolled product 1 is cooled in the cooling zone 5.

The flat rolled product 1 is cooled in the cooling zone 5 while it is oriented obliquely. In the present context "oriented obliquely" means that the flat rolled product 1 is turned according to the schematic view in FIG. 3 about an axis running in the transporting direction x such that one side edge 6 of the flat rolled product 1 is oriented higher up than the other side edge 7 of the flat rolled product 1.

The apparatus has transport rollers 8 for transporting the flat rolled product 1 from the rolling stand to the cooling zone 5 and for transporting the flat rolled product 1 through the cooling zone 5 (and generally also downstream thereof). The transport rollers 8 are arranged sequentially in series, viewed in the transporting direction x. They have first axes of rotation 9 about which the transport rollers 8 are rotatable. The transport rollers 8 are therefore arranged between the rolling stand 2 and the cooling zone 5, in the cooling zone 5 and generally also downstream of the cooling zone 5. The flat rolled product 1 is guided and supported by means of the transport rollers 8 from the rolling stand 2 to the cooling zone 5, guided and supported through the cooling zone 5 and—at least as a general rule—also guided and supported downstream of the cooling zone 5. The flat rolled product 1 is guided in the horizontal transport direction x. Some of the reference numerals for the transport rollers 8 and the first axes of rotation 9 are additionally designated in the figures by a suffixed lowercase letter (a, b, . . . ) so that they can be differentiated from one another if necessary. Insofar as reference is made hereinafter generally only to the transport rollers 8 and the first axes of rotation 9, the suffixed lowercase letter is omitted.

Figure 2:
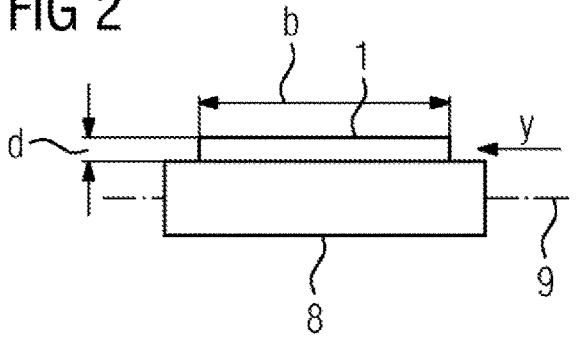
FIG. 2 shows a transport roller and a flat rolled product, viewed in the transporting direction of the flat rolled product.

In the vicinity of the rolling stand 2, the first axes of rotation 9 of the transport rollers 8 are oriented horizontally, according to the schematic view in FIG. 2. Inside the cooling zone 5, on the other hand, at least in a central section of the cooling zone 5, the first axes of rotation 9 of the transport rollers 8 are oriented at a first acute angle α, according to the schematic view in FIG. 3. The corresponding first axes of rotation 9 therefore form the first acute angle α with the horizontal H. Since, in addition, the flat rolled product 1 is supported on the transport rollers 8, the flat rolled product 1 is also oriented at the first acute angle α inside the cooling zone 5. The first acute angle α preferably lies in the range between 5° and 30°, in particular between 10° and 25°. For example, the first acute angle α can lie at approx. 15° to 20°.

In order to position the flat rolled product 1 obliquely, the flat rolled product 1 is turned through the first acute angle α about an axis running in the transporting direction x. After completion of the turning movement about the axis, the flat rolled product 1 is therefore oriented obliquely, as is shown in FIG. 1 and also in FIG. 3. Generally, the flat rolled product 1 is turned before the run-in of the flat rolled product 1 into the cooling zone 5, i.e. before the commencement of the cooling phase in the cooling zone 5. In individual cases—for example because the necessary installation space is not available or because it is aimed to start the cooling of the flat rolled product 1 as soon as possible after the flat rolled product 1 exits the rolling stand 2—it is however possible to turn the flat rolled product 1 also during the run-in of the flat rolled product 1 into the cooling zone 5.

In order to turn the flat rolled product 1 through the acute angle α, the transport rollers 8 are oriented prior to the run-in into the cooling zone 5 and/or during the run-in in the cooling zone 5 in such a way that the first axes of rotation 9 of sequentially arranged transport rollers 8 progressively run more and more obliquely until the first acute angle α is reached. The increase in angle from transport roller 8 to transport roller 8 is generally uniform in this case. If, according to the schematic shown in FIGS. 4 to 6 for example, the transport roller 8*a* or the associated first axis of rotation 9*a* is therefore still oriented horizontally and the transport roller 8*e* or the associated first axis of rotation 9*e* is already oriented below the first acute angle α, then

- the first axis of rotation 9*b* is oriented at somewhat below the angle α/4 with respect to the horizontal H,
- the first axis of rotation 9*c* is oriented at somewhat below the angle α/2 with respect to the horizontal H, and
- the first axis of rotation 9*d* is oriented at somewhat below the angle 3α/4 with respect to the horizontal H.

Analogous statements also apply of course when the flat rolled product 1 is turned by means of more or fewer than five transport rollers 8*a* to 8*e*.

Figure 4:
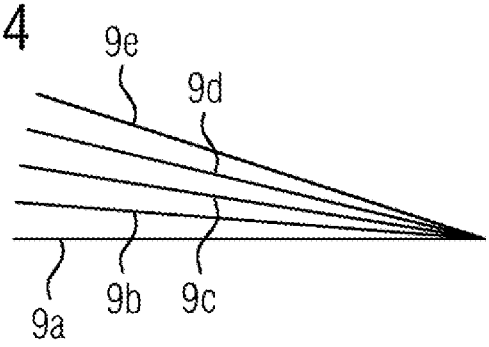
FIG. 4 shows first axes of rotation of a plurality of sequential transport rollers.
Figure 5:
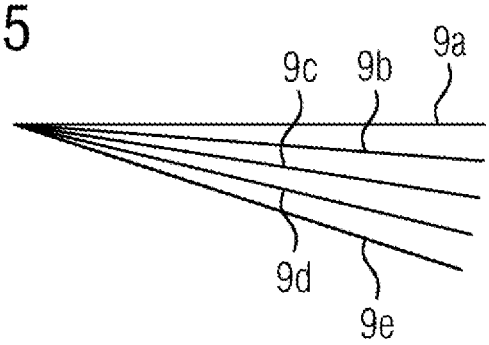
FIG. 5 shows second axes of rotation of a plurality of sequential transport rollers.
Figure 6:
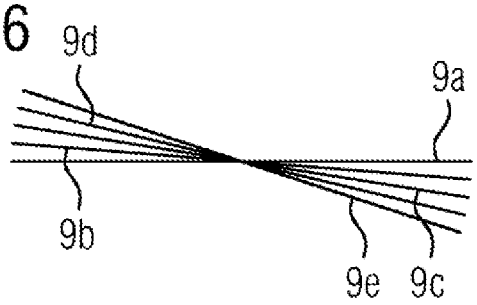
FIG. 6 shows third axes of rotation of a plurality of sequential transport rollers.

It is possible, according to the schematic shown in FIG. 4, that in order to turn the flat rolled product 1 through the first acute angle α, the horizontal positioning of the flat rolled product 1, viewed in the width direction y of the flat rolled product 1, is maintained at one side edge 7 and raised at the other side edge 6. Alternatively, it is also possible, according to the schematic shown in FIG. 5, that in order to turn the flat rolled product 1 through the first acute angle α, the horizontal positioning of the flat rolled product 1, viewed in the width direction y of the flat rolled product 1, is maintained at one side edge 6 and lowered at the other side edge 7. This embodiment is generally to be preferred. Furthermore, it is alternatively possible, according to the schematic shown in FIG. 6, that in order to turn the flat rolled product 1 through the first acute angle α, the horizontal positioning of the flat rolled product 1, viewed in the width direction y of the flat rolled product 1, is raised at one side edge 6 and lowered at the other side edge 7. The associated first axes of rotation 9*a* to 9*e* are shown in FIGS. 4 to 6. However, since the transport rollers 8 generally have uniform diameters, the schematics in FIGS. 4 to 6 are also valid for the top edges of the associated transport rollers 8*a* to 8*e*, on which the flat rolled product 1 is supported.

Thus, irrespective of which of the embodiments of FIGS. 4 to 6 is realized, the raising and/or lowering of the flat rolled product 1 is effected step by step by means of a corresponding orientation of the first axes of rotation 9*a* to 9*e* of sequentially arranged transport rollers 8*a* to 8*e*.

The schematic diagrams of FIGS. 3 to 6 show the corresponding orientation of the transport rollers 8 or the first axes of rotation 9 in the operating state, i.e. while the flat rolled product 1 is initially rolled in the rolling stand 2 and then cooled in the cooling zone 5. It is possible that this orientation is static. Alternatively, it is possible that the transport rollers 8 are pivotable individually or in groups about the axis running in the transporting direction x. For example, according to the schematic shown in FIG. 3, hydraulic actuators 10 may be present by means of which a corresponding adjustment of the orientation can be effected. It is even possible to pivot the transport rollers 8 out of the horizontal H only after the head of the flat rolled product 1 has already passed the respective transport roller 8. It is also possible to provide a correspondingly staggered pivoting of the transport rollers 8. This is explained below with reference to an example, the numeric values stated below being purely exemplary.

Let it be assumed that the first acute angle $\alpha$ equals 20° and the flat rolled product 1 is to be pivoted according to the schematics in FIGS. 4 to 6 by way of the transport rollers 8*a* to 8*e*. In this case the following procedure can be employed for example when a staggered pivoting of the transport rollers 8 is provided:

As soon as the head of the flat rolled product 1 has passed the transport roller 8*b*, the transport roller 8*b* is set to the angle $\alpha/4=5°$. The transport rollers 8*c* to 8*e* and the subsequent transport rollers 8 are set either to the angle $\alpha/4=5°$ or to a slightly lower angle, to 4° for example.

As soon as the head of the flat rolled product 1 has passed the transport roller 8*c*, the transport roller 8*c* is set to the angle $\alpha/2=10°$. The transport rollers 8*d*, 8*e* and the subsequent transport rollers 8 are set either to the angle $\alpha/2=10°$ or to a slightly lower angle, to 9° for example.

An analogous procedure is followed as soon as the head of the flat rolled product 1 has passed the respective next transport roller 8*d*, 8*e*, etc.

After running out from the cooling zone 5—in individual cases already when running out from the cooling zone 5—the flat rolled product 1 is turned once again. In individual cases it may be beneficial to continue turning the flat rolled product 1 until the flat rolled product 1 is oriented completely vertically. Generally, however, the flat rolled product 1 is turned back through the first acute angle $\alpha$ about the axis running in the transporting direction x such that after completion of the reverse turning movement the flat rolled product 1 is oriented horizontally once again. This can clearly be seen from the schematic view shown in FIG. 1.

The reverse turning of the flat rolled product 1 is generally accomplished totally analogously to the turning of the flat rolled product 1. In particular, the flat rolled product 1 is also supported on the associated transport rollers 8 during the reverse turning movement. Downstream of the run-out from the cooling zone 5 and/or in the run-out from the cooling zone 5, the first axes of rotation 9 progressively run less and less obliquely until the horizontal H is reached. If, according to the schematic shown in FIG. 7 for example, the transport roller 8*f* and the associated first axis of rotation 9*f* are (still) oriented below the first acute angle $\alpha$ and the transport roller 8*j* or the associated first axis of rotation 9*j* is (already once again) oriented horizontally, then the first axis of rotation 9*g* is oriented at somewhat below the angle $3\alpha/4$ with respect to the horizontal H, the first axis of rotation 9*h* is oriented at somewhat below the angle $\alpha/2$ with respect to the horizontal H, and the first axis of rotation 9*i* is oriented at somewhat below the angle $\alpha/4$ with respect to the horizontal H.

Analogous statements also apply of course when the flat rolled product 1 is turned back by means of more or fewer than five transport rollers 8*f* to 8*j*.

Figure 7:
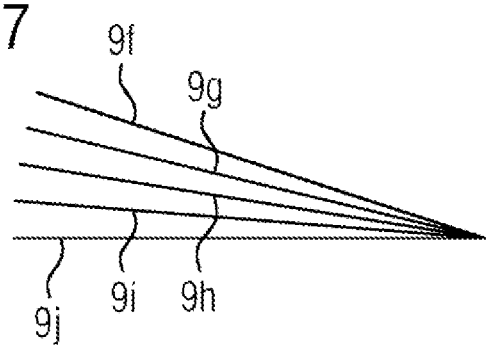
FIG. 7 shows fourth axes of rotation of a plurality of sequential transport rollers.

FIG. 7 shows the inverse case to FIG. 4. The corresponding transport rollers 8 and the associated first axes of rotation 9 may, however, also be oriented inversely to FIG. 5 or inversely to FIG. 6. Irrespective of which embodiment is realized, however, the raising and/or lowering of the flat rolled product 1 is effected step by step by means of a corresponding orientation of the first axes of rotation 9*f* to 9*j* of sequentially arranged transport rollers 8*f* to 8*j*.

The schematic diagram of FIG. 7 shows the corresponding orientation of the transport rollers 8 or of the first axes of rotation 9 in the operating state, i.e. while the flat rolled product 1 is initially rolled in the rolling stand 2 and then cooled in the cooling zone 5. It is possible, as previously illustrated in FIGS. 3 to 6, that this orientation is static. Alternatively, it is possible in this case also that the transport rollers 8 are pivotable individually or in groups about the axis running in the transporting direction x. The statements made in relation to FIGS. 4 to 6 are applicable in an analogous manner.

Figure 3:
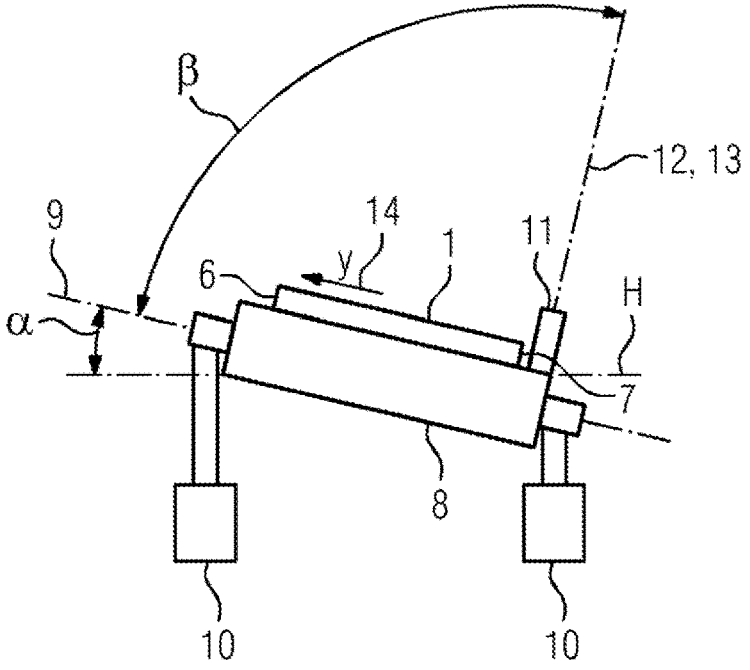
FIG. 3 shows a further transport roller and the flat rolled product, viewed in the transporting direction of the flat rolled product.

According to the schematic shown in FIG. 3, the apparatus preferably has a guide device 11 at the lower side, at least in the section in which the first axes of rotation 9 of the transport rollers 8 form the first acute angle $\alpha$. The flat rolled product 1 is fixed in position, viewed in the width direction y of the flat rolled product, by means of the guide device 11. The guide device 11 may be embodied for example as a rail extending in the transporting direction x of the flat rolled product 1. Alternatively, according to the schematic shown in FIG. 3, the guide device 11 may have holdback rollers which are arranged sequentially in series, viewed in the transporting direction x of the flat rolled product 1, and for their part are rotatable about second axes of rotation 12. In this case the second axes of rotation 12 form a second angle $\beta$ with the width direction y of the flat rolled product 1. Both the respective second axis of rotation 12 and the width direction y of the flat rolled product 1 each form an arm 13, 14 of the second angle $\beta$. Both arms 13, 14 have an upward-directed component. It is possible that the horizontal components of the two arms 13, 14 point in opposite directions. In this case the second angle $\beta$ may be a right angle according to the schematic shown in FIG. 3. Preferably, however, the second angle $\beta$ is an acute angle.

Figure 8:
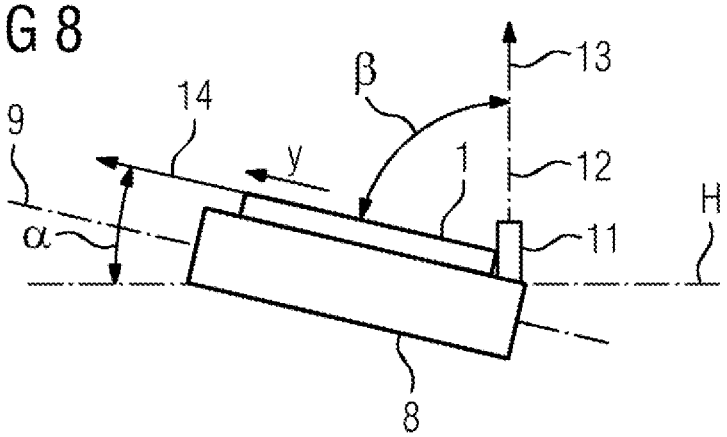
FIG. 8 shows a modification of FIG. 3.
Figure 9:
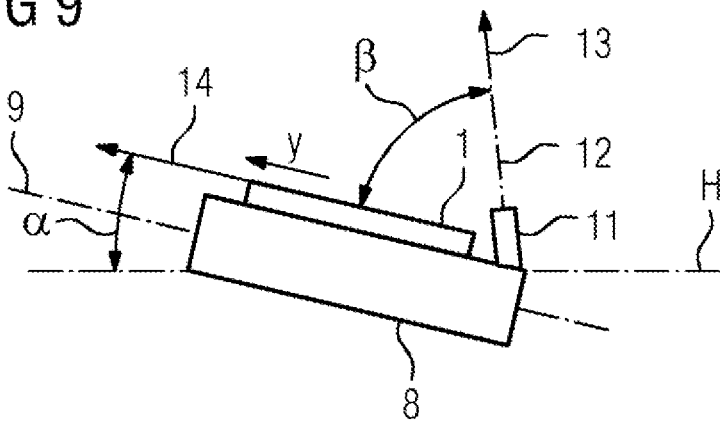
FIG. 9 shows a further modification of FIG. 3.

Also in the case where the second angle $\beta$ is an acute angle, the sum of the first acute angle $\alpha$ and the second acute angle $\beta$ may be even greater than 90° or, according to the schematic shown in FIG. 8, equal to 90°. In this case ($\beta=90°$), the arm 13 formed by the second axis of rotation 12 has no horizontal component, i.e. points vertically upward. Preferably, however, according to the schematic shown in FIG. 9, the sum is less than 90°, in particular less than 85°. In this case the horizontal components of the two arms 13, 14 point in the same direction. In this case too, however, the sum of the two acute angles $\alpha$, $\beta$ is preferably greater than 75°, in particular greater than 80°.

The present invention has many advantages. In particular, even given a relatively small value for the first acute angle α of, for example, just 20°, the coolant spontaneously drains away quickly and reliably to the side from the top surface of the flat rolled product 1. The sideways draining away of the coolant is facilitated in particular by the vapor film which very quickly forms between the flat rolled product 1 and the coolant on the top surface of the flat rolled product 1. Furthermore, the gravitational force of the flat rolled product 1 leads to a precise lateral guidance of the flat rolled product 1. Finally, productivity can be increased because higher transport speeds v are possible than in the prior art.

Although the invention has been illustrated and described in more detail on the basis of the preferred exemplary embodiment, the invention is not limited by the disclosed examples and other variants may be derived herefrom by the person skilled in the art without leaving the scope of protection of the invention.

LIST OF REFERENCE SIGNS

1 Rolled product
2 Rolling stand
3 Working rolls
4 Roll axes
5 Cooling zone
6, 7 Side edges
8 Transport rollers
9, 12 Axes of rotation
10 Hydraulic actuators
11 Guide device
13, 14 Arms of the second angle
b Width
d Thickness
H Horizontal
l Length
v Transport speed
x Transport direction
y Width direction
α First acute angle
β Second angle

What is claimed is:

1. An apparatus for producing a flat rolled metal product, the apparatus comprising:

at least one rolling stand, the rolling stand comprising rolls which are rotatable about respective horizontal axes, such that the flat rolled product on the rolls is oriented horizontally during the rolling in the rolling stand;

a cooling zone arranged downstream of the rolling stand;

between the rolling stand and the cooling zone and also in the cooling zone, transport rollers that are operable for feeding the flat rolled product to the cooling zone in a horizontal transporting direction (x) and the flat rolled product is guided through the cooling zone;

wherein the transport rollers have first axes of rotation;

wherein the first axes of rotation form a first acute angle (α) with the horizontal (H), or the associated transport rollers are pivotable about an axis running in the transporting direction (x) so that the first axes of rotation form the first acute angle (α) with the horizontal (H), at least in a central section of the cooling zone, and before a run-in into the cooling zone and/or during the run-in in the cooling zone, the transport rollers are oriented in such a way that the first axes of rotation of sequentially arranged transport rollers progressively run more and more obliquely until the first acute angle (α) is reached, or the associated transport rollers are pivotable about an axis running in the transporting direction (x) so that the transport rollers are oriented in such a way that the first axes of rotation of sequentially arranged transport rollers progressively run more and more obliquely until the first acute angle (α) is reached; and wherein the first acute angle (α) is in the range 5° and 30°, whereby the first acute angle (α) is great enough so that coolant drains away reliably from a top surface of the flat rolled metal product, and low enough so that the flat rolled metal product continues to be reliably guided by the transport rollers.

2. The apparatus as claimed in claim 1, downstream of a run-out from the cooling zone and/or in the run-out from the cooling zone, the transport rollers are oriented such that the first axes of rotation of sequentially arranged transport rollers run less progressively obliquely until the horizontal (H) is reached, or the associated transport rollers are pivotable about an axis running in the transporting direction (x) such that the first axes of rotation of sequentially arranged transport rollers run less progressively obliquely until the horizontal (H) is reached.

3. The apparatus as claimed in claim 1, further comprising at least in the section in which the first axes of rotation of the transport rollers form the first acute angle (α), the apparatus has a guide device at the lower side, by means of which guide device for fixing the flat rolled product in position, viewed in the width direction (y) of the flat rolled product.

4. The apparatus as claimed in claim 3, further comprising the guide device has holdback rollers arranged sequentially in series, viewed in the transporting direction (x) of the flat rolled product, the holdback rollers are rotatable about second axes of rotation which form a second acute angle (β) with the width direction (y) of the flat rolled product, and the second angle comprising arms having an upward-directed component.

5. The apparatus as claimed in claim 4, further comprising the sum of the first acute angle (α) and the second acute angle (β) is less than 90°.

* * * * *